US008925324B2

(12) United States Patent
Berry et al.

(10) Patent No.: US 8,925,324 B2
(45) Date of Patent: Jan. 6, 2015

(54) TURBOMACHINE INCLUDING A MIXING TUBE ELEMENT HAVING A VORTEX GENERATOR

(75) Inventors: Jonathan Dwight Berry, Simpsonville, SC (US); Chunyang Wu, Greer, SC (US); Baifang Zuo, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 559 days.

(21) Appl. No.: 12/898,267

(22) Filed: Oct. 5, 2010

(65) Prior Publication Data

US 2012/0079829 A1 Apr. 5, 2012

(51) Int. Cl.

| | |
|---|---|
| ***F02C 1/00*** | (2006.01) |
| ***F02G 3/00*** | (2006.01) |
| ***F23R 3/28*** | (2006.01) |

(52) U.S. Cl.

CPC ..... *F23R 3/286* (2013.01); *F23D 2900/00003* (2013.01)

USPC ..... 60/740; 60/737; 60/748; 60/742; 60/772; 60/804

(58) Field of Classification Search

USPC ..... 60/737–748, 804, 772, 776

See application file for complete search history.

(56) References Cited

U.S. PATENT DOCUMENTS

| | | | | |
|---|---|---|---|---|
| 4,412,414 | A | 11/1983 | Novick et al. | |
| 5,213,494 | A | 5/1993 | Jeppesen | |
| 5,259,184 | A | 11/1993 | Borkowicz et al. | |
| 5,526,850 | A | 6/1996 | Sora et al. | |
| 6,438,961 | B2 | 8/2002 | Tuthill et al. | |
| 7,097,347 | B2 | 8/2006 | Vanden Bussche et al. | |
| 7,886,991 | B2 | 2/2011 | Zuo et al. | |
| 2010/0192579 | A1 * | 8/2010 | Boardman et al. | 60/737 |
| 2010/0192581 | A1 | 8/2010 | Ziminsky et al. | |
| 2010/0287942 | A1 * | 11/2010 | Zuo et al. | 60/772 |
| 2011/0113783 | A1 * | 5/2011 | Boardman et al. | 60/723 |
| 2011/0265482 | A1 * | 11/2011 | Parsania et al. | 60/740 |

FOREIGN PATENT DOCUMENTS

| | | | |
|---|---|---|---|
| CN | 1078789 | A | 11/1993 |
| CN | 101713541 | A | 5/2010 |

OTHER PUBLICATIONS

Unofficial translation of Chinese Office Action and Search Report from CN Patent Application No. 201110314231.6 dated Jul. 24, 2014.

* cited by examiner

*Primary Examiner* — Craig Kim

(74) *Attorney, Agent, or Firm* — Cantor Colburn LLP

(57) ABSTRACT

A turbomachine includes a compressor section, a combustor operatively connected to the compressor section, an end cover mounted to the combustor, and an injection nozzle assembly operatively connected to the combustor. The injection nozzle assembly includes a plurality of mixing tube elements. Each of the plurality of mixing tube elements includes a conduit having a first fluid inlet, a second fluid inlet arranged downstream from the first fluid inlet, a discharge end arranged downstream from the first and second fluid inlets, and a vortex generator arranged between the first and second fluid inlets. The vortex generator is configured and disposed to create multiple vortices within the conduit to mix first and second fluids passing through each of the plurality of mixing tube elements.

26 Claims, 9 Drawing Sheets

TURBOMACHINE INCLUDING A MIXING TUBE ELEMENT HAVING A VORTEX GENERATOR

BACKGROUND OF THE INVENTION

The subject matter disclosed herein relates to the art of turbomachine and, more particularly, to a turbomachine including a mixing tube element having a vortex generator.

In general, gas turbine engines combust a fuel/air mixture that releases heat energy to form a high temperature gas stream. The high temperature gas stream is channeled to a turbine section via a hot gas path. The turbine section converts thermal energy from the high temperature gas stream to mechanical energy that rotates a shaft. The turbine section may be used in a variety of applications, such as for providing power to a pump or an electrical generator.

In a gas turbine, engine efficiency increases as combustion gas stream temperatures increase. Unfortunately, higher gas stream temperatures produce higher levels of nitrogen oxide (NOx), an emission that is subject to both federal and state regulation. Therefore, there exists a careful balancing act between operating gas turbine sections in an efficient range, while also ensuring that the output of NOx remains below mandated levels. One method of achieving low NOx levels is to ensure good mixing of fuel and air prior to combustion.

BRIEF DESCRIPTION OF THE INVENTION

According to one aspect of the invention, a turbomachine includes a compressor section, a combustor operatively connected to the compressor section, an end cover mounted to the combustor, and an injection nozzle assembly operatively connected to the combustor. The injection nozzle assembly includes a plurality of mixing tube elements. Each of the plurality of mixing tube elements includes a conduit having a first fluid inlet, a second fluid inlet arranged downstream from the first fluid inlet, a discharge end arranged downstream from the first and second fluid inlets, and a vortex generator arranged between the first and second fluid inlets. The vortex generator is configured and disposed to create multiple vortices within the conduit to mix first and second fluids passing through each of the plurality of mixing tube elements.

According to another aspect of the invention, a mixing tube element includes a conduit having a first fluid inlet, a second fluid inlet arranged downstream from the first fluid inlet, and a discharge end arranged downstream from the first and second fluid inlets, and a vortex generator arranged between the first and second fluid inlets. The vortex generator is configured and disposed to create multiple vortices within the conduit to mix first and second fluids passing through the mixing tube element.

According to yet another aspect of the invention, a method of mixing first and second fluids in a turbomachine injection nozzle assembly includes passing a first fluid into a first fluid inlet of a mixing tube element arranged in the injection nozzle assembly, guiding a second fluid into a second fluid inlet of the mixing tube element. The second fluid inlet is arranged downstream of the first fluid inlet. A portion of the first fluid is introduced into a vortex generator arranged between the first and second fluid inlets, multiple vortices are generated in the mixing tube element to mix the first and second fluids.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
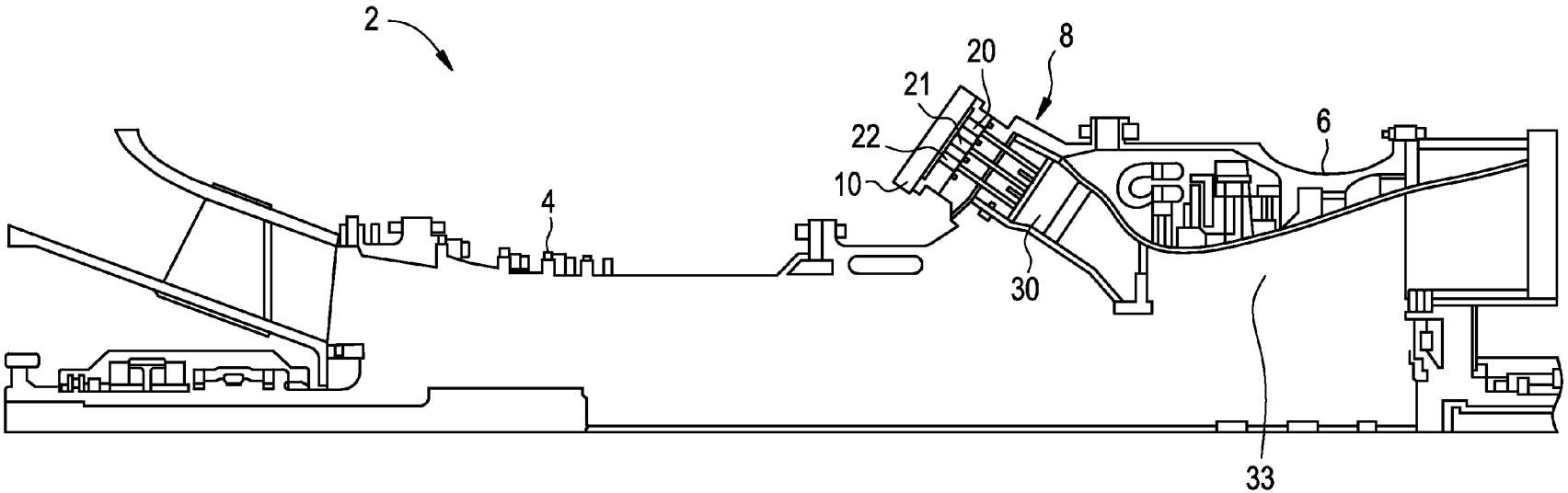
FIG. 1 is a partial, cross-sectional schematic view of a turbomachine including mixing tube elements provided with vortex generators in accordance with an exemplary embodiment.

With initial reference to FIG. 1, a turbomachine constructed in accordance with exemplary embodiments is indicated generally at 2. Turbomachine 2 includes a compressor section 4 operatively connected to a turbine section 6 via a common compressor/turbine shaft (not shown). Compressor section 4 is also connected to turbine section 6 through a combustor assembly 8. Although shown with only a single combustor assembly, it should be understood that turbomachine 2 may include a plurality of combustor assemblies arranged in, for example, a can-annular array. Combustor assembly 8 includes an endcover 10 which, as will be discussed more fully below, supports a plurality of injection nozzle assemblies 20-22. As will be discussed more fully below, injection nozzle assemblies 20-22 deliver a fuel/air mixture into a combustion chamber 30. The fuel air mixture is combusted for form combustion gases that are delivered to a first stage 33 of turbine section 6.

Figure 2:
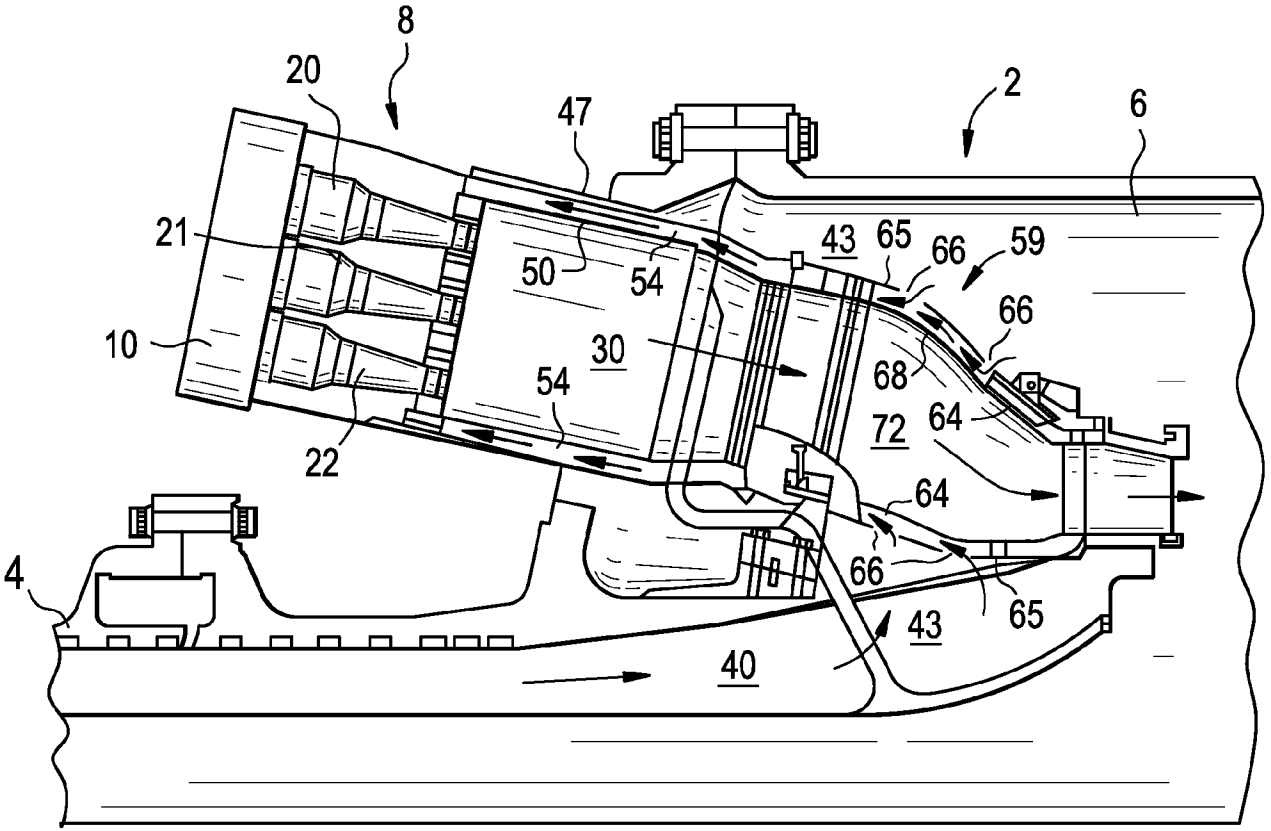
FIG. 2 is a partial, cross-sectional view of a combustor including a plurality of injection nozzle assemblies in accordance with an exemplary embodiment.

As best shown in FIG. 2, combustor assembly 8 is coupled in flow communication with compressor section 4 and turbine section 6. Compressor section 4 includes a diffuser 40 fluidly coupled to a compressor section discharge plenum 43. Combustor assembly 8 further includes a combustor casing 47 and a combustor liner 50. As shown, combustor liner 50 is positioned radially inward from combustor casing 47 so as to define combustion chamber 30. An annular combustion chamber cooling passage 54 is defined between combustor casing 47 and combustor liner 50. A transition piece 59 couples combustor assembly 8 to turbine section 6. Transition piece 59 channels combustion gases generated in combustion chamber 30 downstream towards first stage 33 of turbine section 6. Towards that end, transition piece 59 includes an inner wall 64 and an outer wall 65. Outer wall 65 includes a plurality of openings 66 that lead to an annular passage 68 defined between inner wall 64 and outer wall 65. Inner wall 64 defines a guide cavity 72 that extends between combustion chamber 30 and turbine section 6.

At this point it should be understood that the above-described construction is presented for a more complete understanding of the exemplary embodiments, which are directed to the particular structure of injection nozzle assemblies 20-22. The particular form of the turbomachine into which the injection nozzle assemblies 20-22 of the exemplary embodiment may be incorporated may vary. As each injection nozzle assembly 20-22 is similarly formed, a detailed description will follow with reference to injection nozzle assembly 20 with an understanding that injection nozzle assemblies 21 and 22 include corresponding structure.

Figure 3:
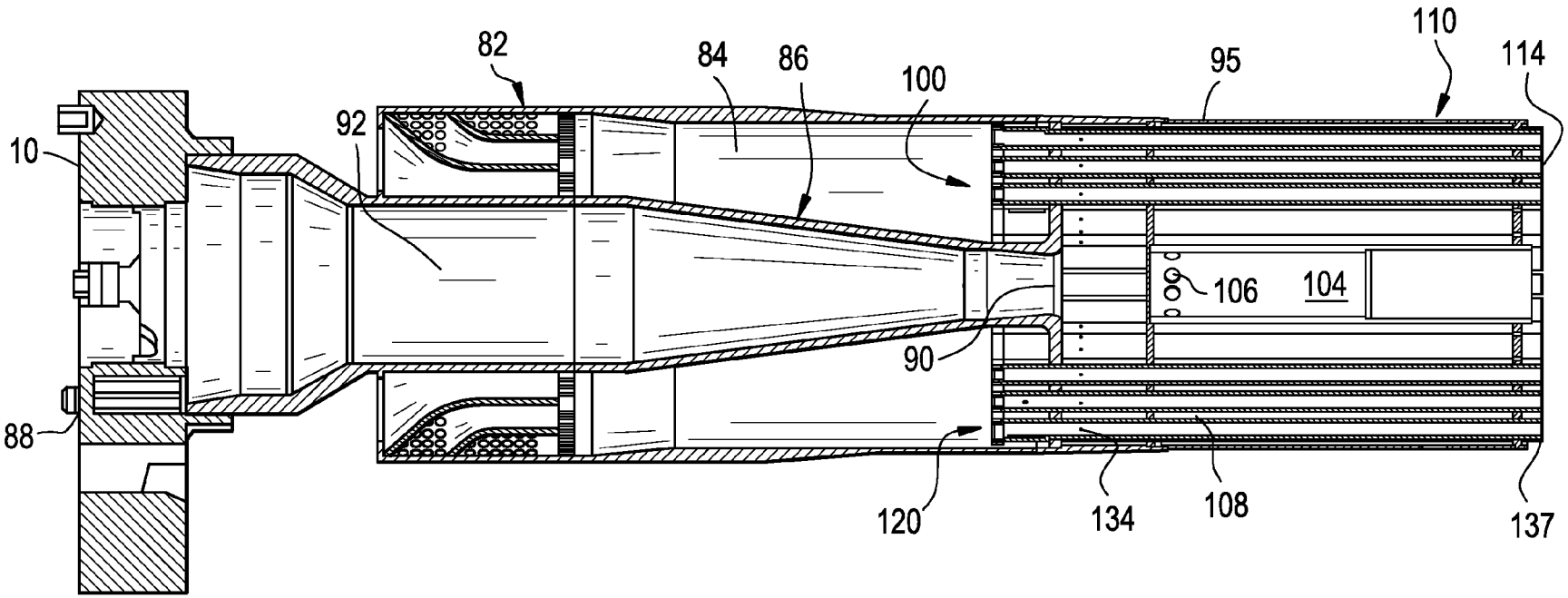
FIG. 3 is a partial cross-sectional view of an injection nozzle assembly of FIG. 3 including a plurality of mixing tube elements in accordance with an exemplary embodiment.

As shown in FIG. 3, injection nozzle assembly 20 includes an outer housing 82 that defines a first fluid plenum 84. A second fluid delivery tube 86 passes through first fluid plenum 84. Second fluid delivery tube 86 includes an inlet 88 provided at endcover 10 that extends to an outlet 90 through a second fluid plenum 92. Outlet 90 terminates at a second fluid core or plenum 95 that extends about a portion of a plurality of mixing tube elements 100. Mixing tube elements 100 are arranged in an annular array about outlet 90 and a resonator 104. Resonator 104 includes a plurality of cooling fluid inlets, one of which is indicated at 106, which direct a cooling fluid, such as extraction air, through a central area of mixing tube elements 100. Additional cooling fluid is passed through a plurality of cooling openings, one of which is indicated at 110, into a cooling fluid plenum 108 that extends around mixing tube elements 100 between second fluid core 95 and an end face 114 of injection nozzle assembly 20.

Figure 4:
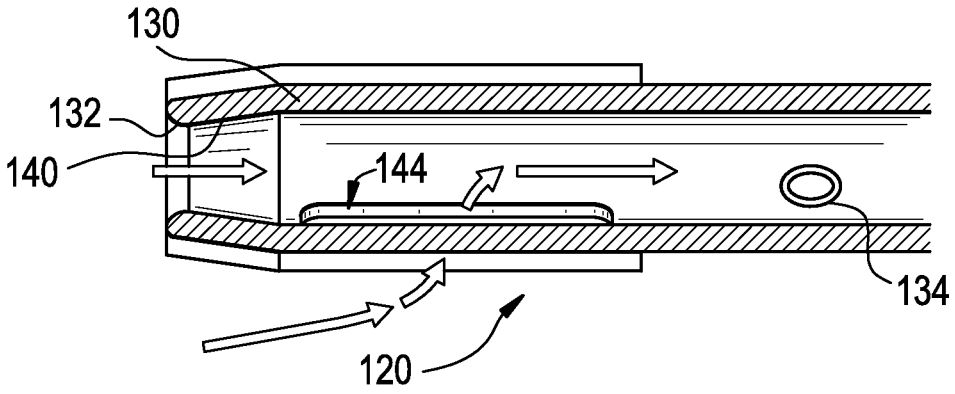
FIG. 4 is a detail view of a first fluid inlet, a second fluid inlet, and vortex generator in one of the plurality of mixing tube elements of FIG. 3.

At this point reference will now be made to FIG. 4 which illustrates one of the plurality of mixing tube elements 100 indicated generally at 120 with an understanding that the remaining mixing tube elements 100 include similar structure. Mixing tube element 120 includes a conduit 130 having a first fluid inlet 132, a second fluid inlet 134 and a discharge end 137 (FIG. 3). Second fluid inlet 134 is arranged downstream from first fluid inlet 132. Discharge end 137 is arranged downstream from first fluid inlet 132 and second fluid inlet 134. In the exemplary embodiment shown, first fluid inlet 132 is provided with a flow restriction 140. Flow restriction 140 establishes a desired flow rate through mixing tube element 120.

Figure 5:
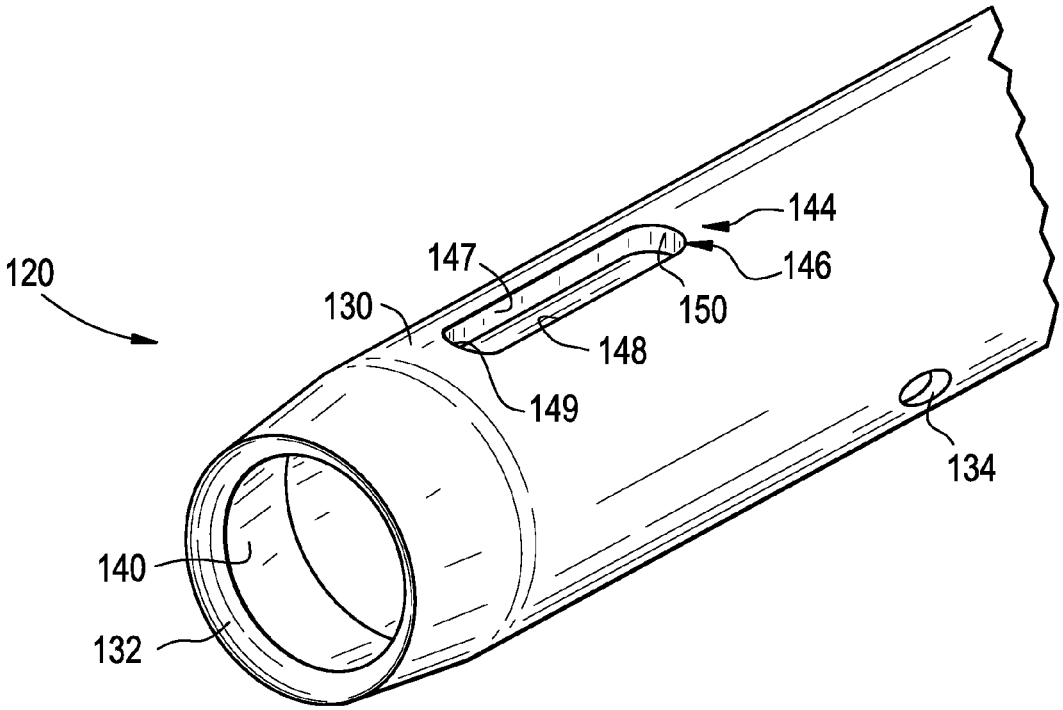
FIG. 5 is a partial perspective view of the mixing tube element of FIG. 4 illustrating the first fluid inlet and vortex generator in accordance with one aspect of the exemplary embodiment.
Figure 6:
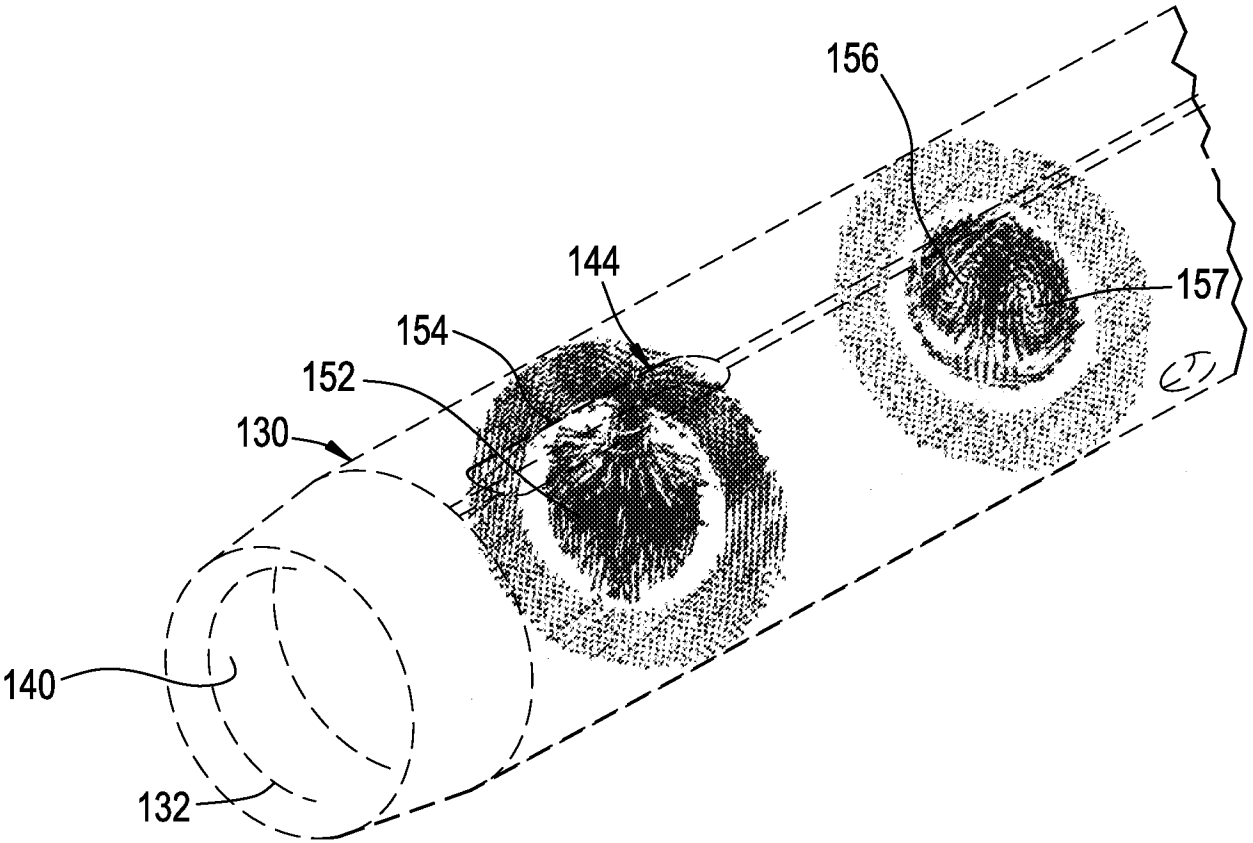
FIG. 6 is a graphical representation of a double vortex created by the vortex generator illustrated in FIG. 5.

As best shown in FIG. 5, mixing tube element 120 includes a vortex generator 144. In accordance with the exemplary embodiment shown, vortex generator 144 comprises an opening 146 in the form of an elongated slot formed between first fluid inlet 132 and second fluid inlet 134. More specifically, vortex generator 144 includes first and second opposing elongated side walls 147 and 148 that are joined by corresponding first and second curvilinear end walls 149 and 150. With this arrangement, a first fluid, for example air, is passed into first fluid plenum 84 and directed towards mixing tube element 120. A first portion of the first fluid enters into first fluid inlet 132 as an axial flow such as shown at 152 in FIG. 6. A second portion of the first fluid 154 enters mixing tube element 120 through vortex generator 144 as a generally perpendicular flow indicated generally at 154. Perpendicular flow 154 acts upon axial flow 152 to create first and second flow vortices 156 and 157 just down stream from second fluid inlet 134. First and second vortices substantially fill a volume of mixing tube element 120. In this manner, once a second fluid, for example fuel, passes into mixing tube element 120, first and second flow vortices 156 and 157 create a mixture that is passed from discharge end 137 into combustion chamber 30. First and second flow vortices 156 and 157 enhance mixing of the first and second fluid so as to facilitate more complete combustion. At this point it should be understood that the first and second fluids, e.g., fuel and air, are mixed in a similar fashion in each of the plurality of mixing tube elements 100. In order to enhance mixing, vortex generated in adjacent mixing tube elements are off-set from each other avoid creating flow patterns that may starve one or more of the mixing tube elements 100 of the perpendicular flow. It should be also understood that the number of vortices generated in mixing tube element can vary.

Figure 7:
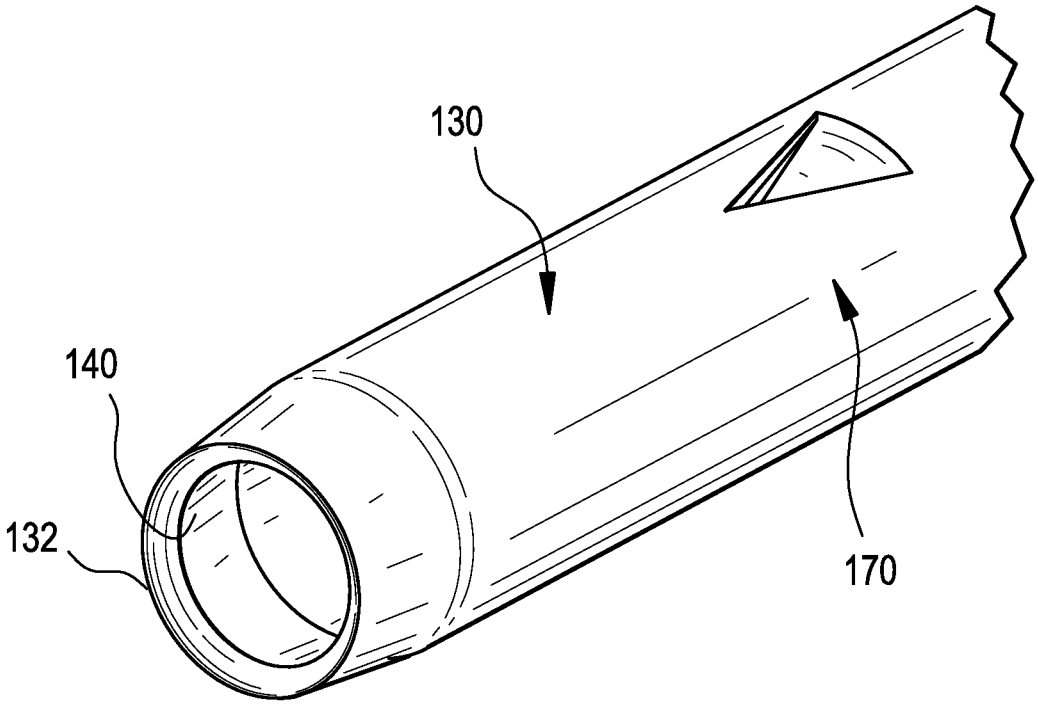
FIG. 7 is a partial perspective view of a mixing tube element illustrating a vortex generator in accordance with another aspect of the exemplary embodiment.
Figure 8:
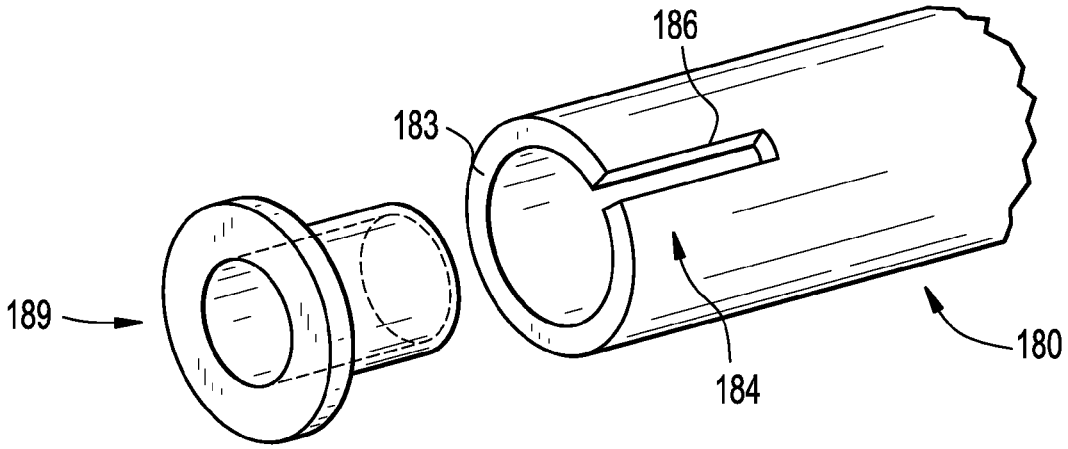
FIG. 8 is a partial perspective view of a mixing tube element illustrating a vortex generator in accordance with yet another aspect of the exemplary embodiment.
Figure 9:
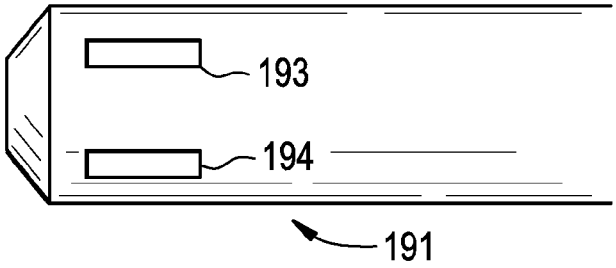
FIG. 9 is a plan view of a mixing tube element having a vortex generator in accordance with still another aspect of the exemplary embodiment.
Figure 10:
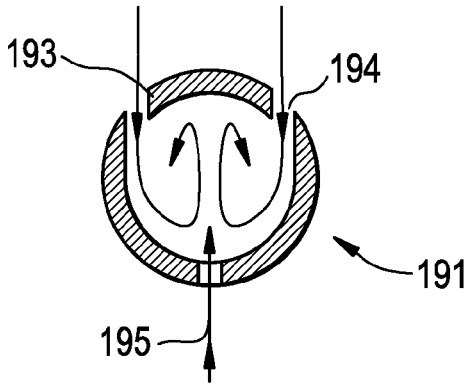
FIG. 10 is an elevational view of the mixing tube element of FIG. 9.
Figure 11:
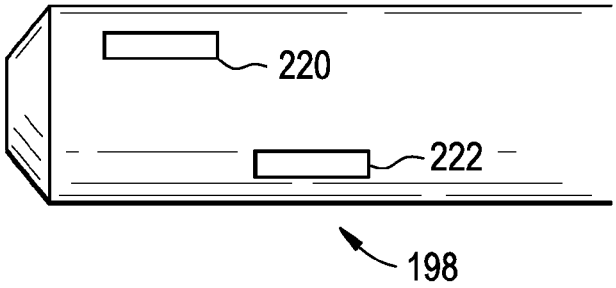
FIG. 11 a plan view of a mixing tube element having a vortex generator in accordance with yet still another aspect of the exemplary embodiment.

It should also be understood that the shape, number and location of the vortex generator may vary in accordance with the exemplary embodiments. For example, in FIG. 7, wherein like reference numbers represent corresponding parts in the respective views, a vortex generator 170 is shown to include a generally angular profile. The generally angular profile takes the form of a triangular or "delta wing" profile. FIG. 8 illustrates a mixing tube element 180 having a first end 183 provided with a vortex generator 184. Vortex generator 184 takes the form of a slot 186 having an open end (not separately labeled) that extends from first end 183. An orifice cap 189 is inserted into first end 183 to close off the open end of vortex generator 184 and provide a desired flow restriction for mixing tube element 180. FIGS. 9 and 10 illustrate a mixing tube element 191 having multiple vortex generators 193-195, and FIG. 11 illustrates a mixing tube element 198 having multiple off-set or staggered vortex generators 220 and 222.

At this point it should be understood that the exemplary embodiment describe a system for generating a dual vortex flow within a mixing tube element to enhance mixing of first and second fluids. The enhanced mixing leads to a more even fuel/air ratio which, in turn, leads to reduced emissions of the turbomachine. It should be further understood that, as noted above, the type, number and location and arrangement of the vortex generator(s) can vary. It should be also understood that the mixing tube elements, in addition to use in a turbomachine, can be employed in a wide variety of applications where enhanced mixing of multiple fluids is desired.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a compressor section;

a combustor operatively connected to the compressor section;

an end cover mounted to the combustor; and an injection nozzle assembly operatively connected to the combustor, the injection nozzle assembly including a plurality of mixing tube elements surrounded by a housing and further defining a first fluid plenum and a second fluid plenum, the second fluid plenum being distinct from and arranged downstream of the first fluid plenum, each of the plurality of mixing tube elements including a conduit having a first fluid inlet fluidically connected to the first fluid plenum, a second fluid inlet fluidically connected to the second fluid plenum and arranged downstream from the first fluid inlet, a discharge end arranged downstream from the first and second fluid inlets, and a vortex generator arranged between the first and second fluid inlets and fluidically connected to the first fluid plenum, the vortex generator being configured and disposed to create multiple vortices within the conduit to mix first and second fluids passing through each of the plurality of mixing tube elements.

2. The turbomachine according to claim 1, wherein the first fluid inlet includes a flow restriction.

3. The turbomachine according to claim 1, wherein the vortex generator comprises at least one opening formed in the conduit.

4. The turbomachine according to claim 3, wherein the at least one opening is an elongated slot.

5. The turbomachine according to claim 4, wherein the elongated slot includes curvilinear portions.

6. The turbomachine according to claim 3, wherein the at least one opening comprises an angular opening.

7. The turbomachine according to claim 6, wherein the angular opening is a triangular opening.

8. The turbomachine according to claim 3, wherein the at least one opening comprises multiple openings.

9. The turbomachine according to claim 3, wherein the at least one opening on one of the plurality of mixing tube elements is off-set from the at least one opening on adjacent ones of others of the plurality of mixing tube elements.

10. The turbomachine according to claim 1, wherein the multiple vortices include at least a first vortex and a second vortex that is distinct from the first vortex.

11. The turbomachine according to claim 10, wherein the first and second vortices counter-rotate.

12. A mixing tube element comprising:

a conduit having a longitudinal axis, a first fluid inlet configured and disposed to direct a first fluid from a first fluid plenum in an axial direction relative to the longitudinal axis, a second fluid inlet arranged downstream from the first fluid inlet, the second fluid inlet being configured and disposed to direct a second fluid from a second fluid plenum distinct from the first fluid plenum in a transverse direction relative to the longitudinal axis, and a discharge end arranged downstream from the first and second fluid inlets; and a vortex generator arranged between the first and second fluid inlets, the vortex generator being configured and disposed to create multiple vortices within the conduit to mix first and second fluids passing through the mixing tube element.

13. The mixing tube element according to claim 12, wherein the first fluid inlet includes a flow restriction.

14. The mixing tube element according to claim 12, wherein the vortex generator comprises at least one opening formed in the conduit.

15. The mixing tube element according to claim 14, wherein the at least one opening is an elongated slot.

16. The mixing tube element according to claim 15, wherein the elongated slot is curvilinear.

17. The mixing tube element according to claim 14, wherein the at least one opening comprises an angular opening.

18. The mixing tube element according to claim 17, wherein the angular opening is a triangular opening.

19. The mixing tube element according to claim 14, wherein the at least one opening comprises multiple openings.

20. The mixing tube element according to claim 19, wherein one of the multiple openings is off-set from another of the multiple openings.

21. The mixing tube element according to claim 12, wherein the multiple vortices include at least a first vortex and a second vortex that is distinct from the first vortex.

22. The mixing tube element according to claim 21, wherein the first and second vortices counter-rotate.

23. A method of mixing first and second fluids in a turbomachine injection nozzle, the method comprising:

passing a first fluid from a first fluid plenum into a first fluid inlet of a mixing tube element arranged in the injection nozzle assembly;

guiding a second fluid from a second fluid plenum distinct from the first fluid plenum into a second fluid inlet of the mixing tube element, the second fluid inlet being arranged downstream of the first fluid inlet;

introducing a portion of the first fluid into a vortex generator arranged between the first and second fluid inlets; and generating multiple vortices in the mixing tube element to mix the first and second fluids.

24. The method of claim 23, wherein introducing the portion of the first fluid into a vortex generator comprises passing the portion of the first fluid through at least one opening formed in the mixing tube element between the first and second fluid inlets.

25. The method of claim 23, wherein generating multiple vortices includes generating at least a first vortex and a second vortex that is distinct from the first vortex.

26. The method of claim 25, wherein generating the first and second vortices includes generating first and second counter-rotating vortices.

* * * * *